US007798216B2

(12) United States Patent
Phillips et al.

(10) Patent No.: US 7,798,216 B2
(45) Date of Patent: Sep. 21, 2010

(54) WELLBORE SURVEYING SYSTEM AND METHOD

(75) Inventors: Wayne J. Phillips, Houston, TX (US); Christopher R. Chia, Al Khobar (SA); Richard V. C. Wong, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 229 days.

(21) Appl. No.: 11/616,547

(22) Filed: Dec. 27, 2006

(65) Prior Publication Data

US 2008/0156485 A1 Jul. 3, 2008

(51) Int. Cl.
*E21B 47/00* (2006.01)
*E21B 47/02* (2006.01)

(52) U.S. Cl. ..... 166/254.2; 175/40; 175/45; 175/50

(58) Field of Classification Search ..... 166/254.1, 166/254.2, 250.01; 175/40, 45, 50; 33/313; 324/346
See application file for complete search history.

(56) References Cited

U.S. PATENT DOCUMENTS 3,112,442 A * 11/1963 Bennett ..... 324/347
3,224,513 A * 12/1965 Weeden, Jr. ..... 340/853.4
4,399,692 A * 8/1983 Hulsing et al. ..... 73/152.54
4,485,563 A * 12/1984 Sharp et al. ..... 33/314
4,560,934 A * 12/1985 Dickinson, III ..... 324/323
5,452,518 A 9/1995 DiPersio
5,606,124 A 2/1997 Doyle et al.
5,657,547 A 8/1997 Uttrecht et al.
6,209,391 B1 * 4/2001 Dallas ..... 73/152.46
6,736,221 B2 5/2004 Chia et al.
2002/0005298 A1 * 1/2002 Estes et al. ..... 175/45
2003/0121657 A1 * 7/2003 Chia et al. ..... 166/255.2
2004/0107590 A1 6/2004 Russell et al.

FOREIGN PATENT DOCUMENTS

GB 2351807 1/2001

* cited by examiner

*Primary Examiner*—David J Bagnell
*Assistant Examiner*—Cathleen R Hutchins
(74) *Attorney, Agent, or Firm*—David J. Smith

(57) ABSTRACT

A method for surveying a wellbore may include deploying a deployable wellbore survey tool into the wellbore, collecting survey data as the deployable survey tool traverses the wellbore, and determining wellbore position information based on the survey data. In one example the method may include landing the deployable wellbore survey tool on a component of a bottom hole assembly.

33 Claims, 5 Drawing Sheets

WELLBORE SURVEYING SYSTEM AND METHOD

BACKGROUND OF THE INVENTION

1. Field of the Invention

The present invention relates to wellbore surveying systems and techniques. More particularly, the present invention relates to systems techniques for surveying wellbores and/or determining position of a wellbore in the Earth.

2. Background of the Related Art

Wellbores are drilled to locate and produce hydrocarbons. A downhole drilling tool with a bit at an end thereof is advanced into the ground to form a wellbore. As the drilling tool is advanced, a drilling mud is pumped from a surface mud pit, through the drilling tool and out the drill bit to cool the drilling tool and carry away cuttings. The fluid exits the drill bit and flows back up to the surface for recirculation through the tool. The drilling mud is also used to form a mudcake to line the wellbore.

Fluids, such as oil, gas and water, are commonly recovered from subterranean formations below the earth's surface. Drilling rigs at the surface are often used to drill wellbores into the Earth's crust to the location of the subsurface fluid deposits to establish fluid communication with the surface through the drilled wellbore. In many cases, the subsurface fluid deposits are not located directly below the drilling rig surface location. In these cases, a "directional wellbore" is drilled. A directional wellbore is a wellbore that deviates from vertical. Downhole drilling equipment may be used to directionally steer the drilling tool to drill the wellbore to known or suspected fluid deposits using directional drilling techniques to laterally displace the borehole and create a directional wellbore.

Directional wellbores are drilled through Earth formations according to a selected or desired trajectory, however, many factors may combine to unpredictably influence the actual trajectory of a wellbore. It is desirable to accurately determine the wellbore trajectory in order to guide the wellbore to its geological and/or positional objective. Thus, it may be desirable to measure the inclination, azimuth, depth, and position of the drill bit during wellbore operations to determine whether the selected trajectory is being maintained within acceptable limits.

Surveying of wellbores is commonly performed using downhole survey instruments. These instruments typically contain sets of orthogonal accelerometers, magnetometers, and/or gyroscopes. These survey instruments are used to measure the direction and magnitude of the local gravitational field, magnetic field, and Earth spin rate vectors. These measurements correspond to the instrument position and orientation in the wellbore, with respect to these vectors. Wellbore position, inclination, and/or azimuth may be estimated from the instrument's measurements. Techniques for surveying of wellbores are disclosed in U.S. Pat. No. 5,452,518 to Dispersio; U.S. Pat. No. 5,606,124 to Doyle, et al.; GB Patent No. 2351807A to Shirasaka, et al.; U.S. Pat. No. 5,657,547 to Uttecht, et al.; and Patent Publication No. 2004/0107590 A1 to Russell, et al.

In general, wellbore surveys are performed by while-drilling tools that are located in the bottom hole assembly ("BHA") of a drilling system. One technique is to wait for a break in the drilling process, which typically happens when additional sessions of drill pipe are being added to the drill string. When the drilling has stopped, the survey instruments may make measurements that are not affected by the movement and vibrations that are created by the rotation of the drill string and the action of the drill bit on the bottom of the hole. It is noted that this is only one example of a technique for making wellbore surveys. Wellbore surveys may be initiated and acquired at any time, including during drilling operations. In addition, wellbore surveys may be performed by wireline tools that are run into the wellbore when the drill string has been removed or that are run inside the drill string.

There are many sources of measurement uncertainty and inaccuracy. For example, magnetic measuring techniques suffer from the inherent uncertainty in global magnetic models used to estimate declination at a specific site, as well as local perturbations in the magnetic field due to the nearby magnetic materials or the casing of the wellbore or of a nearby well. Similarly, gravitational measuring techniques suffer from movement of the downhole tool and uncertainties in the accelerometers. Gyroscopic measuring techniques, for example, suffer from drift uncertainty. Depth measurements are also prone to uncertainties including mechanical stretch from gravitational forces and thermal expansion, for example.

SUMMARY OF THE INVENTION

In one aspect, the invention relates to a method for surveying a wellbore that includes deploying a deployable wellbore survey tool into the wellbore, collecting survey data as the deployable survey tool traverses the wellbore, and determining wellbore position information based on the survey data. In one example the method may include landing the deployable wellbore survey tool on a component of a bottom hole assembly.

In another aspect, the invention may relate to a method of retrieving a wellbore survey tool that includes deploying a retrieval device into the wellbore, connecting the retrieval device to the deployable wellbore survey tool, collecting survey data during an ascent of the deployable wellbore survey tool, and determining position information based on the additional survey data.

In another aspect, the invention may relate to a deployable wellbore survey tool that includes a housing, one or more gyroscopes disposed within the casing, and a lower connector for landing on a component of a bottom hole assembly. The deployable wellbore survey tool may be configured to be deployed into a wellbore and collect survey data during travel between a surface and the bottom hole assembly.

DETAILED DESCRIPTION OF THE INVENTION

Figure 1B:
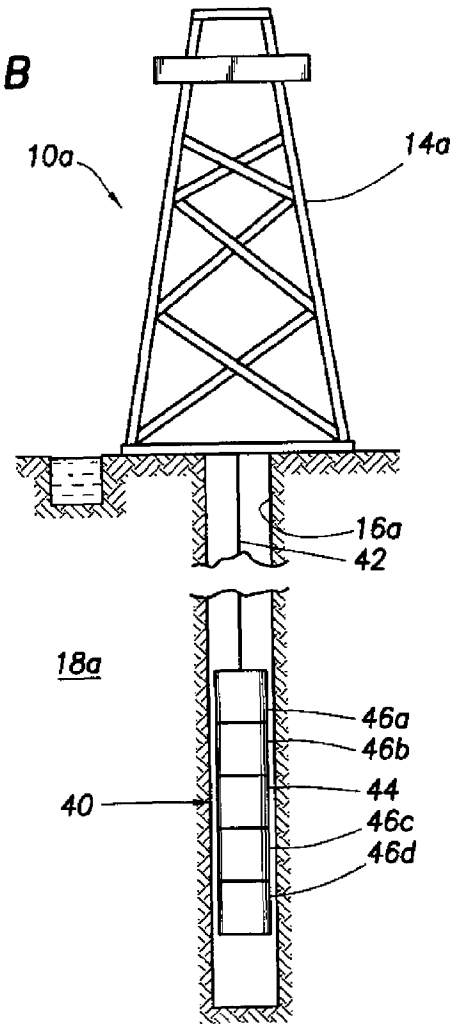
FIG. 1B is a schematic view of one example of a wireline tool.
Figure 1A:
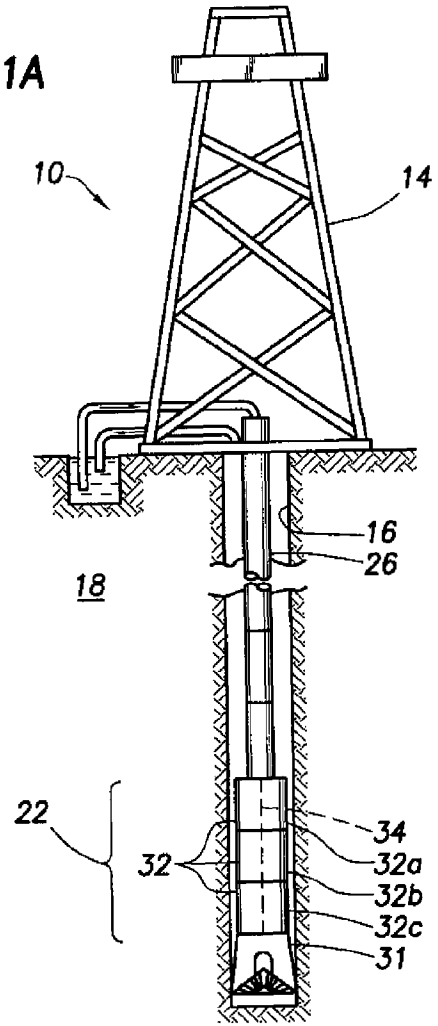
FIG. 1A is a schematic view of one example of a drilling system.

FIG. 1A shows one example of a drilling system 10 that includes a drilling rig 14 positioned above a wellbore 16 penetrating a subterranean formation 18. In general, the drilling system 10 is provided with a downhole drilling assembly 22 that includes one or more while-drilling tools or downhole components 32*a-c* and a drill bit 31. The downhole drilling assembly 22, sometimes called a bottom home assembly ("BHA"), may include any number and types of while-drilling tools, such as sensors, telemetry devices, and directional drilling tools. The downhole drilling assembly 22 may be deployed into the wellbore 16 from the rig 14 via a drill string 26. The downhole drilling assembly 22 may drill the wellbore 16 and may be operatively connected to the rig via the drill string 26.

The downhole drilling assembly 22 includes a drill bit 31, and a plurality of interconnected downhole components 32*a-c*. By way of example, these downhole components 32*a-c* are illustrated in FIG. 1A. The downhole components 32*a-c* may be any type of component or tool capable of forming a part of the downhole drilling assembly 22. For example, the downhole components 32*a-c* may include a wellbore survey tool, a downhole communication unit, a directional drilling system, a measurement while drilling tool, a logging while drilling tool, a testing tool, or a sampling tool. By way of example, the downhole component 32*a* may be a downhole communication unit such as a mud pulse telemetry tool or an electromagnetic telemetry tool, and the downhole component 32*b* may be wellbore survey tool. The downhole component 32*c* may form a rotary steerable system.

The downhole drilling assembly 22 may also include a downhole communications network 34 for establishing communication between the various downhole components 32*a-c*. The downhole communications network 34 is indicated in FIG. 1A using dashed lines. The downhole communication network 34 is typically integrated into each of the downhole components 32*a-c*. However, the downhole communication network 34 may be formed by any suitable type of communication system, such as an electronic communication system or an optical communication system. The electronic communication system may be either wired or wireless, and can pass information by way of electromagnetic signals, acoustic signals, or any other method for transmitting data.

The drilling assembly survey tool 32*b* of the downhole drilling assembly 22 is capable of collecting survey data and other information using known survey techniques while the downhole drilling assembly 22 drills the wellbore 16. The drilling assembly survey tool 32*b* may be used to survey and/or collect data before, during, or after a drilling operation. The measurements taken using the drilling assembly survey tool 32*b* may be done continuously and/or at discrete positions in the wellbore 16. The drilling assembly survey tool 32*b* is also capable of surveying and/or collecting data as the downhole drilling assembly 22 is extended downhole and/or retrieved uphole in a continuous and/or discrete manner. It is noted that the position of the drilling assembly survey tool 32*b* may vary, depending on the particular bottom hole assembly that is required or desired. For example, a drilling assembly survey tool may be the upper-most tool or component in a BHA or downhole drilling assembly.

In one example, the drilling assembly survey tool 32*b* may form a gryo-magnetic assembly that includes one or more one, two, or three axis gyroscopes mounted in sets in close proximity to one or more magnetometers and/or accelerometers. The gyroscopes measure the Earth's spin vector, while enables the tool to determine the true north reference azimuth. This information may be used in conjunction with the magnetic north and gravitational vectors measured by the magnetometers and accelerometers.

FIG. 1B depicts another example of a wellbore survey system 10*a* constructed in accordance with the present invention. The wellbore survey system 10*a* includes a downhole assembly 40 suspended from a rig 14*a* into a wellbore 16*a*. The downhole assembly 40 may be any type of deployable tool or assembly that is capable of performing formation evaluation or surveying such as a wireline tool, a coiled tubing tool, a slick line tool or other type of downhole tool or assembly. The downhole assembly 40 of FIG. 1B is a conventional wireline tool deployed from the rig 14*a* into the wellbore 16*a* via a wireline cable 42 and positioned adjacent to a subterranean formation 18*a*.

The downhole assembly 40 may be provided with a wellbore survey tool 44, and a plurality of other interconnected modules or tools 46. By way of example, four modules 46 are illustrated in FIG. 1B, and designated by the reference numbers 46*a*, 46*b*, 46*c*, and 46*d*. The modules 46 may be any type of modules for use with the downhole assembly 40, such as testing modules, sampling modules, hydraulic modules, electronic modules, a downhole communication unit, or the like.

The wellbore survey tool 44 of the downhole assembly 40 is lowered into the wellbore 16*a* to survey and/or collect data. The wellbore survey tool 44 of the downhole assembly 40 is capable of surveying and/or collecting data as the downhole assembly 40 is extended downhole and/or retrieved uphole in a continuous and/or discrete manner.

Figure 1D:
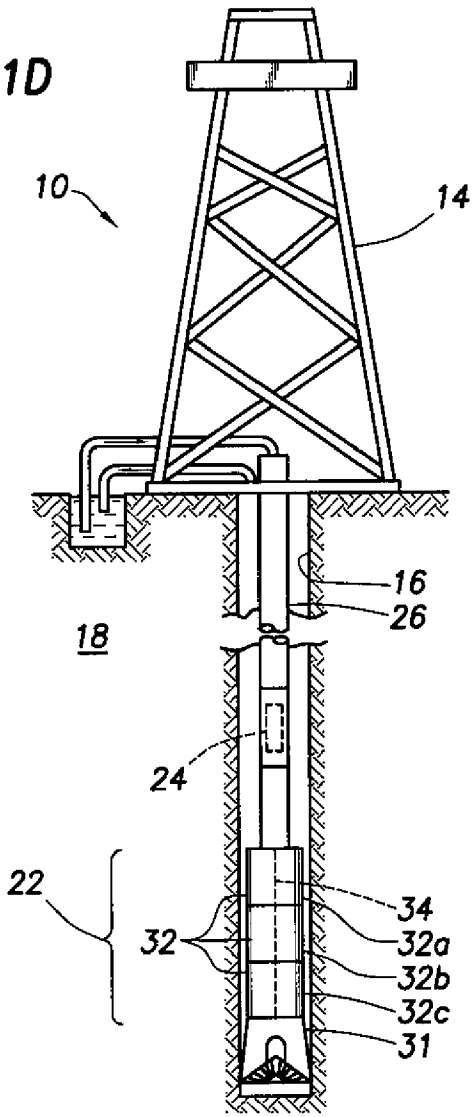
FIG. 1D is a schematic view of one example of a drilling system.
Figure 1C:
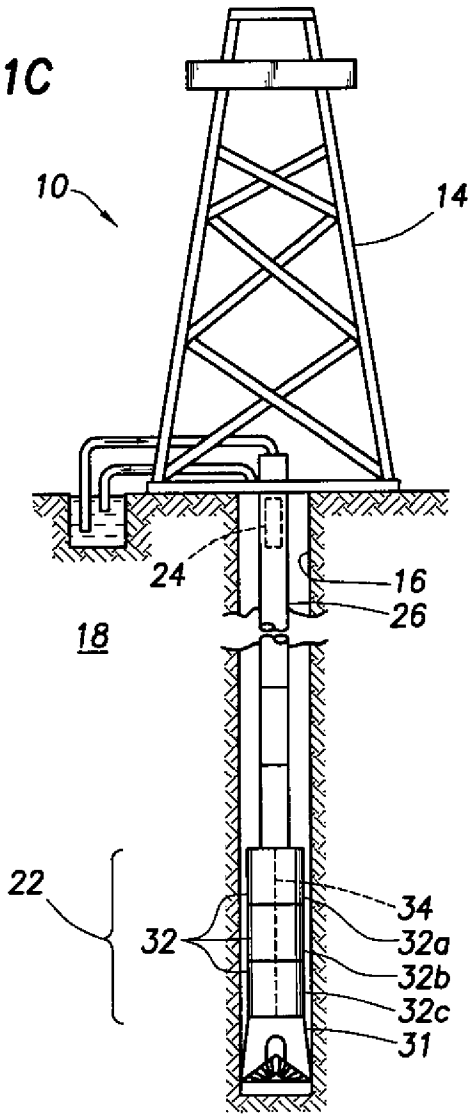
FIG. 1C is a schematic view of one example of a drilling system.

FIG. 1C shows the drilling system 10 of FIG. 1A with the addition of a deployable wellbore survey tool 24 positioned in the drill string 26, near the top of the wellbore 16. From this position, a deployable wellbore survey tool 24 may be deployed through the center of the drill string 26. As will be described below, a deployable wellbore survey tool 24 may form a self-contained unit that includes multiple one, two, or three axis gyroscope accelerometers, and/or magnetometers. The deployable wellbore survey tool 24 may include a battery or other temporary power source.

The deployable wellbore survey tool 24 may be deployed through the drill string in a free-fall mode, such that high accuracy inertial and other measurements may be made during the traverse from the top of the wellbore 26 to the drilling assembly 22 at the bottom of the wellbore 16. In high-angle wellbore applications, a deployable wellbore survey tool 24 may be deployed and hydraulically pumped to the bottom of the drill string 26 using the standard rig pumps (not shown) in a normal operating configuration. In still another example, the deployable wellbore survey tool 24 may be deployed into a wellbore on a wireline, slickline, or other device.

In operation, the deployable wellbore survey tool 24 may be initialized at the surface with an absolute surface positional and orientation reference. For example, the initial reference may include a latitude, longitude, altitude, and the tools direction an inclination. This initial point may be used as a reference or origination point for an inertial displacement survey of the wellbore position during the descent of the deployable tool 24 through the drill string 26.

FIG. 1D shows a deployable wellbore survey tool 24 in a position mid-way down the drill string 26 during its descent. As the deployable wellbore survey tool 24 traverses the wellbore 16, it may record inertial and other survey data using combinations of gyroscope, magnetometer, and accelerometer sensors during the descent to the downhole drilling assembly 22.

Figure 1F:
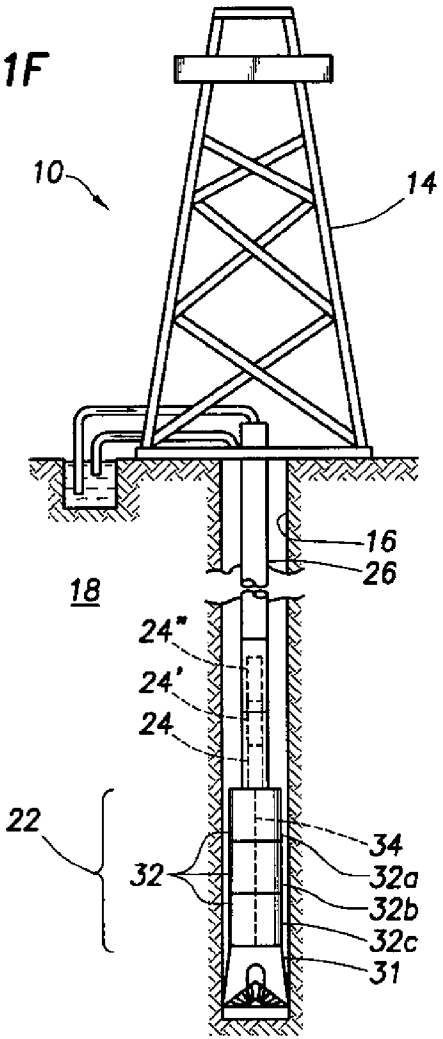
FIG. 1F is a schematic view of one example of a drilling system.
Figure 1E:
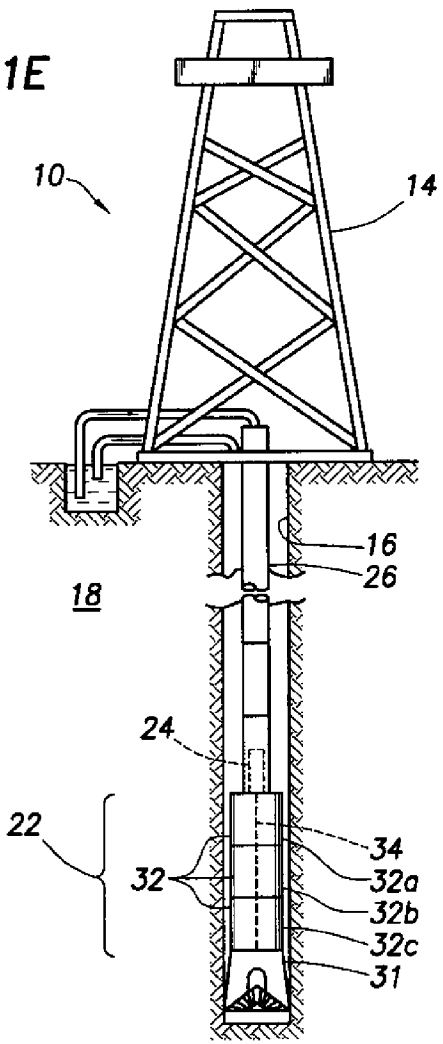
FIG. 1E is a schematic view of one example of a drilling system.

Upon arrival at the bottom of the drill string 26, as shown in FIG. 1E, the deployable wellbore survey tool 24 may engage with the upper-most module or tool in the drilling assembly 22. In the example of FIG. 1E, the deployable wellbore survey tool 24 is engaged with a communication tool 32*a*, such as a mud-pulse telemetry tool, an electromagnetic telemetry tool, or a telemetry tool connected to a wired drill pipe. In another example, a wellbore survey tool may form the upper most tool or module in a downhole drilling tool, and the deployable wellbore drilling tool may engage with the wellbore survey tool. Other types of tools or modules may form the uppermost tool or module in a bottom hole assembly or downhole drilling assembly, as is known in the art. In one example, once the deployable wellbore survey tool 24 is connected with the drilling assembly 22, it may communicate via a downhole communication network 34 with any tool or module in the drilling assembly 22.

Once a deployable wellbore survey tool 24 is engaged with a downhole drilling assembly 22, the deployable wellbore survey tool 24 may transfer the data collected during the survey made as the deployable wellbore survey tool 24 descended through the drill string 26. This data transfer may update the wellbore position using the highly-accurate data collected during the survey, and such data may be transmitted to the surface computer unit 25 using known telemetry methods.

At any later time during the drilling process, a subsequent deployable wellbore survey tool may be deployed through the drill string to make an additional survey and provide an additional high accuracy update of the position and path of the wellbore. For example, an additional deployable wellbore survey tool may be deployed as shown in FIGS. 1C-E, above. As shown in FIG. 1F, a second deployable wellbore survey tool 24' may be deployed and landed above the first deployable wellbore survey tool 24. The second deployable wellbore survey tool 24' may engage with the first deployable wellbore survey tool 24 and communicate with the downhole drilling assembly 22 through the first deployable wellbore survey tool 24 and the downhole communication network 34. FIG. 1F also shows a third deployable wellbore survey tool 24" that has descended the drill string 26 and engaged with the second deployable wellbore survey tool 24'. The third deployable wellbore survey tool 24" may communicate with the first and second deployable wellbore survey tools 24, 24', as well as with other components in the downhole drilling assembly 22.

At any stage of the drilling process, one or more deployable wellbore survey tools may be retrieved from the downhole engaged position. In one example, a deployable wellbore survey tool 24, such as the one shown in FIG. 1E, is retrieved using a wireline overshot, where drilling is temporarily suspended and a wire cable is spooled into the drill string 26 to latch onto the deployable wellbore survey tool 24. It may be possible to perform an additional wellbore survey while retrieving the wellbore survey tool 24. For example, an electric wireline may be for retrieval, and the deployable survey tool 24 may be re-initialized an additional inertial survey performed so that the position of the wellbore 26 may be re-surveyed during the retrieval of the deployable wellbore survey tool 24. Following the reverse survey, an absolute surface reference may be used to reverse calculate the position of the wellbore 26. In this manner, the deployable wellbore survey tool 24 may be used to make a second, independent survey of the wellbore position. It is noted that a deployable wellbore survey tool 24 may be retrieved with devices other than a wireline, such as a slickline or small diameter drill pipe.

In another example, a deployable wellbore survey tool may be independently deployed within a wellbore without the use of a drilling assembly survey tool. Such a deployment may use a wireline to traverse all or part of the wellbore. In addition, a deployable wellbore survey tool may be placed in a liner or casing before it is run into the wellbore. A wellbore survey may then be obtained without the use of any additional rig time. The deployable wellbore survey tool may be retrieved during a subsequent traverse of the wellbore with a wireline or with drill pipe. Upon retrieval, the position of the wellbore may be estimated using the data that was stored in the tool. In one example, a deployable wellbore survey tool may be independently deployed, and it may perform an additional survey during retrieval. In such a case, two independent surveys may be calculated from the data stored in the tool.

One possible advantage of this technique includes providing a more accurate description of the wellbore position using multiple overlapping survey measurements that may be combined using known techniques (see for example U.S. Pat. No. 6,736,221). This allows improved reservoir delineation, penetration of smaller geological targets at greater distances, and the ability to drill wellbores faster with less overall non-drilling time to achieve a given level of accuracy, as well as the overall ability to place multiple wellbores in closer proximity because of the increased wellbore positional accuracy.

Figure 2:
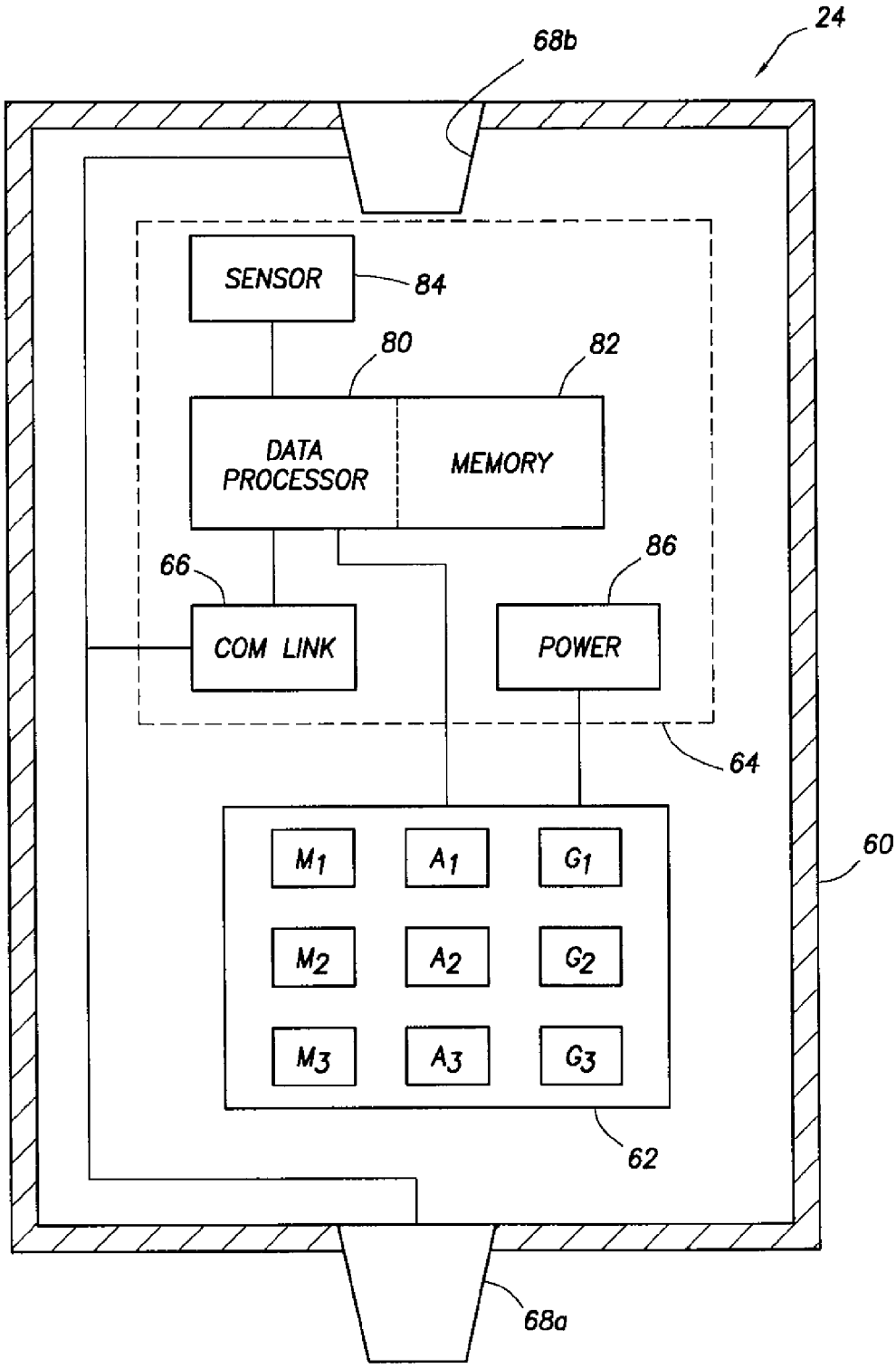
FIG. 2 is a block diagram view of one example of a deployable wellbore survey tool.

FIG. 2 shows a block diagram of one example of a deployable wellbore survey tool 24 that includes a housing 60, a sensor assembly 62, and an electronics package 64. The electronics package 64 includes a communication link 66 providing communication between the sensor assembly 62 and the electronics package 64. In addition, the communications link 66 may enable the wellbore survey tool 24 to communicate with other tools and modules in the drilling assembly (22 in FIG. 1A) through the connections 68*a*, 68*b* and the downhole communication network (34 in FIG. 1A).

The housing 60 of the deployable wellbore survey tool 24 may be sized and constructed to be deployed through the drill string (26 of FIG. 1A) and may be operatively connected with the downhole drilling assembly (22 in FIG. 1A). In one example, the deployable wellbore survey tool 24 includes one or more connectors 68 (two connectors 68*a* and 68*b* shown by way of example in FIG. 2) for mating with a connector (not shown) of another device or component located externally of the housing 60, such as the upper component of the downhole drilling assembly 22 (shown in FIG. 1A), or another deployable wellbore survey tool 24'. The lower connector 68*a* serves to connect the communication link 66 with an upper module or component of the drilling assembly (22 in FIG. 1A). When connected, the deployable wellbore survey tool 24 may be connected to the downhole communications network (34 in FIG. 1A) of the downhole drilling assembly (22 in FIG. 1A). The connector 68*b* serves to connect the communication link 66 with a connector of an adjacently disposed deployable wellbore survey tool, such as the second deployable survey tool 24' shown in FIG. 1F. Further, the upper connector 68*b* may be used to connect the deployable wellbore survey tool 24 to any other tool or device that may be deployed in the wellbore. Using the two connectors 68*a* and 68*b*, deployable wellbore survey tools may be interconnected together to permit communication between two or more deployable wellbore survey tools 24, 24', 24" and the downhole drilling assembly 22, as shown in FIG. 1F.

The connectors 68*a* and 68*b* may be devices capable of establishing communication between the wellbore survey tool 24 and the device to which the wellbore survey tool is connected. For example, the connector 68*a* may be implemented as a spearhead connector, and the connector 68*b* may be a female type connector. The connectors 68*a*, 68*b* may establish any type of connection with other tools and modules. For example, the connectors 68*a*, 68*b* may form an inductive coupling with adjacent tools, modules, or components. In another example, the connectors 68*a*, 68*b* may enable a direct connection between the deployable wellbore survey tool 24 and other devices. In another example, the connectors 68*a*, 68*b* may enable wireless communication between the deployable wellbore survey tool 24 and other devices.

The deployable wellbore survey tool 24 can also be provided with a latching mechanism tool (not shown) for connecting the deployable wellbore survey tool 24 to another downhole tool, such as the communication tool 32*a* in the downhole drilling assembly 22 shown in FIG. 1E. The latching mechanism may be integrally constructed with the connectors 68*a*, 68*b*, as for example when the connector 68 is implemented as a spearhead connector. However, it should be understood that the latching mechanism may be constructed separately from the connectors 68*a*, 68*b*. Although the communication link 66 has been discussed above as including the connectors 68*a*, 68*b* for establishing communication between the deployable wellbore survey tool 24 and the downhole communication network 34, it should be understood that the communication link 66 may be implemented in any suitable manner for establishing communication with the downhole communication network 34 or another downhole tool or component. For example, the communication link 66 may be implemented as a wireless communication link.

The electronics package 64 may be provided with a data processor 80, a memory 82, one or more sensors 84, and one or more power supplies 88. The data processor 80 may be any type of device capable of executing the logic described herein for controlling the communication link 66, and collecting and processing information from the sensor 84 or the sensor package 62. The memory 82 may be on board the data processor 80 or may be a separate element in communication with the data processor 80. The memory may store computer-readable instructions as well as acquired and processed data. The data processor 80 is typically a central processing unit (CPU), a microcontroller, or a digital signal processor.

The power supply 88 may be any type of device or system for supplying power to the components within the electronic package 64, and/or the sensor assembly 62. Typically, the power supply 88 will be implemented either by internal power batteries, or a link to an external power source. Although only one power supply 88 is depicted in FIG. 2, it should be understood that the deployable wellbore survey tool 24 may be provided with more than one power supply to increase reliability and provide redundancy.

The memory unit 82 may be used for recording survey data as the deployable wellbore survey tool 24 is either stationary within the wellbore 16, or 16*a*, moving into the wellbore 16, or 16*a*, or being retrieved from the wellbore 16, or 16*a*. It should be understood that the data processor 80 may be programmed with either software or firmware to provide a variety of different logging modes for collecting the survey data from the sensor assembly 62 and sensor 84.

The sensor 84 may be used for measuring or recording any type of downhole parameter, such as temperature and pressure. Although only one of the sensors 84 has been shown in FIG. 2 for purposes of brevity, it should be understood that the deployable wellbore survey tool 24 may be provided with one or more than one of the sensors 84.

The sensor assembly 62 is provided with one or more magnetometers, as indicated by the reference numerals M1, M2 and M3; one ore more accelerometer as indicated by the reference numerals A1, A2 and A3, as well as a plurality of sets of gyroscopes as indicated by the reference numerals G1, G2, and G3. The gyroscopes measure the Earth's spin vector, which enables a calculation of the true north referenced azimuth in all orientations of the sensor assembly 62. The magnetometers and/or accelerometers may be used to measure the magnetic north referenced azimuth and inclination with respect to gravity to provide additional survey data.

Figure 3:
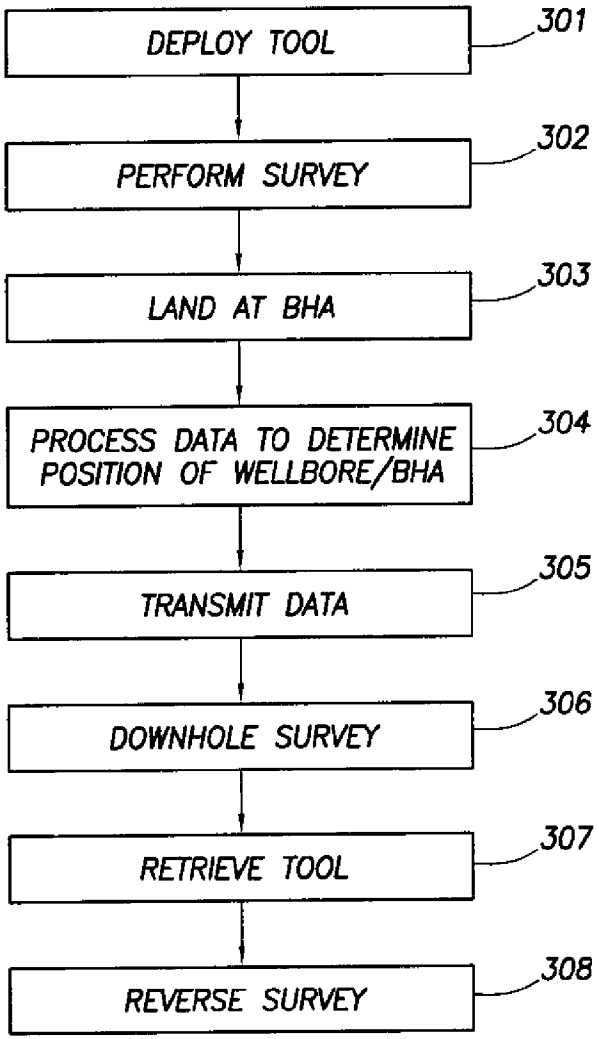
FIG. 3 is a flow diagram illustrating an exemplary method of making a wellbore survey.

FIG. 3 shows one example of a method for making a wellbore survey using a deployable wellbore survey tool. The method may include deploying the tool, at 301. Deploying the tool may include initializing the tool, and it may also include providing position and orientation references. In one example, the position reference may be an absolute position of the wellhead that is know that is input to the deployable wellbore survey tool. In one particular example, a GPS system my be used to provide the position and/or orientation information. Deploying the tool may also include releasing the deployable survey tool so that it may free fall through the drill string. In another example, the deployable tool may be pumped through the drill string or run via a wireline.

The method may next include performing a survey, at 302. The survey may be performed as the tool descends through the drill string, either under the force of gravity or the force of pumping. The survey data may be collected by sensors included within the survey tool, such as gyroscopes, accelerometers, and magnetometers. The acquired sensor data and the processed data may be stored in the memory of the deployable wellbore survey tool.

Next, the method may include landing the wellbore survey tool on the drilling assembly, at 303. In one example, the deployable wellbore survey tool includes a latching mechanism so that the deployable wellbore survey tool may connect or latch with the drilling assembly. In one example, the deployable wellbore survey tool may include a pin connector that mates and latches with a box connector on the drilling assembly to enable communication with the drilling assembly. In one particular example, the deployable wellbore survey tool may be one of a plurality of deployable wellbore survey tools that have been deployed in the wellbore, and a particular deployable wellbore survey tool may mate and latch with another deployable wellbore survey tool that had been previously deployed and latched with the drilling assembly. In another example, the deployable survey tool may mate and latch with a component in the drilling assembly, such as a downhole survey tool or a telemetry tool.

Next, the method may include processing the survey data to determine the position of the wellbore and/or the drilling assembly, at 304. In one example, the deployable wellbore survey tool includes a processor that processes the survey data to determine the path or trajectory of the wellbore and the final position of the deployable wellbore survey tool based on the survey data and the initial position.

It is noted that the processing of the acquired sensor data does not limit the invention. For example, the acquired data may be processed by the deployable wellbore survey tool to determine position information about the wellbore. In another example, the acquired data is transmitted to a component of the drilling assembly after the deployable wellbore survey tool lands, where the acquired data is processed. In another example, the acquired data may be retrieved from the deployable wellbore survey tool upon its retrieval or the attachment of a wireline tool, and the acquired data may be analyzed at the surface computer unit 25. In another example, the survey data may be transmitted from the deployable wellbore survey tool to a telemetry component of the drilling assembly, and the data may be transmitted to the surface computer unit 25 for analysis. Examples of telemetry systems include mud pulse telemetry, electromagnetic telemetry, and wired drill pipe. Other systems may be used without departing from the scope of the invention.

Next, the method may include transmitting the data, at 305. A deployable wellbore survey tool may transmit the survey data and/or the position information to another downhole component. In one example, the deployable wellbore survey tool makes a communication connection when it mates and latches with the drilling assembly. In another example, the deployable wellbore survey tool makes a wireless data transmission to the drilling assembly. In another example, the survey data and/or the wellbore position data may be transmitted up hole by the telemetry tool in the drilling assembly using known telemetry techniques. For example, the data may be sent up hole using mud pulse telemetry, an electromagnetic telemetry tool, or wired drill pipe. Other telemetry techniques may be used.

It is noted that in certain examples, the order of the method steps may be changed. For example, the survey data may be transmitted to a telemetry tool and then uphole before the data is processed to determine the position of the wellbore. In another example, the survey data may be processed in a downhole component other than the deployable wellbore survey tool. In another example, the survey data may be processed with other sensor data to improve the accuracy of the survey and the estimated wellbore trajectory. Further, in another example, the data may be stored in the deployable telemetry tool, without transmitting or processing the data. In such an example, the data may be retrieves and processed when the deployable wellbore survey tool is retrieved form the wellbore.

Next, the method may include performing downhole surveys, at 306. Once a deployable wellbore survey tool has landed and latched to the drilling assembly, it may be used to make downhole surveys. Even in the situation where the drilling assembly includes a downhole survey tool, the deployable wellbore survey tool may make additional measurements to improve accuracy or to serve as a redundant system, in the event that the downhole survey tool fails. The deployable wellbore survey tool may communicate with the drilling assembly through a communication connection.

Figure 4:
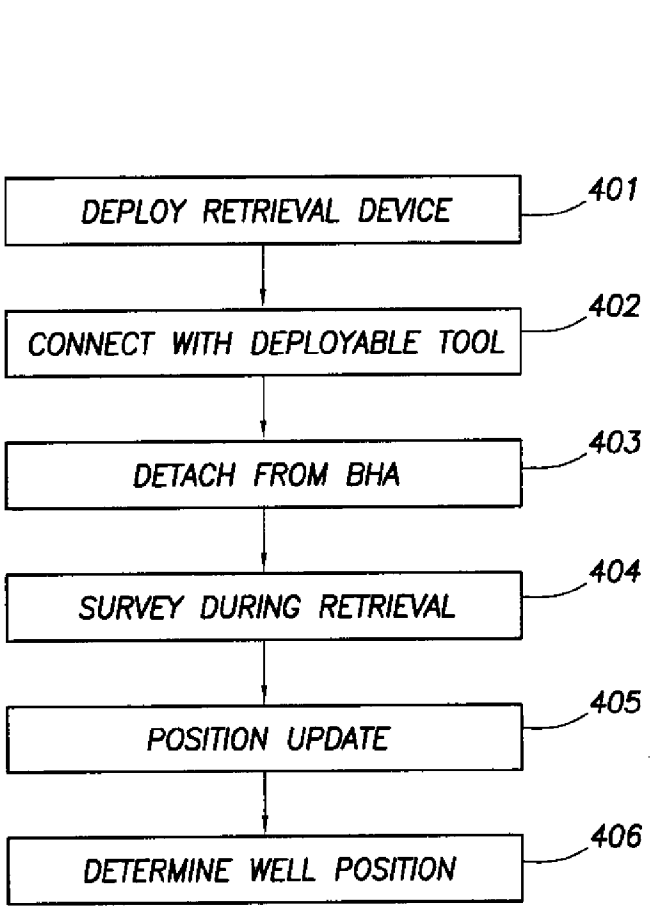
FIG. 4 is a flow diagram illustrating an exemplary method of retrieving a deployable wellbore survey tool.

Next, the method may include retrieving the one or more deployable wellbore survey tools, at 307. A deployable wellbore survey tool may be retrieved during drilling operations. One example of a method for retrieving a deployable wellbore survey tool is shown in FIG. 4, discussed below. In at least one example, more than one deployable wellbore survey tool may be retrieved simultaneously by attaching a retrieval device to the bottom-most deployable wellbore survey tool.

In one example, the deployable wellbore survey tool may make an additional survey of the wellbore during the retrieval, as the tool traverses the wellbore in the upward direction, at 308. Upon being retrieved to the surface, the data stored within the deployable wellbore survey tool may be uploaded to a surface computer unit 25 for processing.

FIG. 4 shows one example of a method for retrieving a deployable wellbore survey tool that has been deployed. The method may include deploying a retrieval device, at 401. A retrieval device may include a wireline, a slickline, or any other device used to retrieve objects from a wellbore. In one example, the retrieval device may be an electric wireline.

Next, the method may include connecting the retrieval device with the deployable wellbore survey tool, at 402. For example, a wireline may be deployed into the drill string and connected to a deployable wellbore survey tool that is landed on the drilling assembly. In another example, a slickline may be used to connect with a deployable wellbore survey tool.

Next, the method may include detaching the deployable wellbore survey tool from the BHA, at 403. In the cases where the deployable wellbore survey tool is connected, this step may be performed prior to retrieval of the deployable wellbore survey tool. In another example, a deployable wellbore survey tool may be landed on top of the drilling assembly, but not connected. In such an example, detaching may be unnecessary.

Next, the method may include retrieving the deployable survey tool and performing an additional survey during the retrieval, at 404. In one example, an electric wireline is connected to a deployable wellbore survey tool, and the tool is re-initialized and detached from the drilling assembly. The deployable wellbore survey tool then performs an additional wellbore survey by collecting survey data as the deployable survey tool is retrieved. The data may be collected from survey sensors. Examples of survey sensors include gyroscopes, accelerometers, and magnetometers.

Next, the method may include providing position and/or orientation updates, at 405. In one example, a position and orientation update may be provided from the known position and orientation of the wellhead. It is noted that in some cases, it may not be necessary to provide a position update. For example, a deployable survey tool may store wellhead position information that was obtained or provided prior to the tool being deployed in the wellbore.

Next, the method may include determining the position of the wellbore and of the drilling assembly and drill bit, at 406. In one example, the survey data is processed within the deployable survey tool to determine the location information. In another example, the data is uploaded to a computer for processing. Such computer may be located at the wellsite, or the data may be transmitted offsite for processing.

During the drilling operations the gyro-sensor based survey data may be used to quantify and apply a reference error correction to the magnetic sensor outputs such as to improve the accuracy and quality of the magnetic sensor readings. This technique is unique in that the improved referencing is done simultaneously as measurements are obtained from a single sensor assembly, and which is also more accurate than current techniques where separate instrument packages must be run in sequence to achieve a similar result. This information obtained from the improved referencing technique could then be modeled and used for subsequent or lower cost magnetic-only sensor runs, such as for a standard MWD unit, where the derived corrections may be applied in later parts of the well construction phase within the same wellbore 16.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A method for surveying a wellbore, comprising:

deploying a deployable gyro-magnetic survey tool in a drilling assembly while drilling into the wellbore;

collecting survey data as the deployable gyro-magnetic survey tool traverses the wellbore; and while drilling, dynamically updating wellbore position information based on the survey data with the survey tool remaining in the wellbore.

2. The method of claim 1, further comprising obtaining initial position and orientation data.

3. The method of claim 2, wherein obtaining initial position and orientation data comprises inputting a known wellhead position.

4. The method of claim 2, wherein obtaining initial position and orientation data comprises querying a Global Positioning System.

5. The method of claim 1, further comprising landing the deployable gyro-magnetic survey tool on a component of a bottom hole assembly.

6. The method of claim 5, wherein the component of the bottom hole assembly comprises an additional deployable wellbore survey tool.

7. The method of claim 5, wherein the component of the bottom hole assembly comprises one selected from the group consisting of a downhole survey tool and a telemetry tool.

8. The method of claim 5, wherein landing the deployable wellbore survey tool on a component of the bottom hole assembly comprises mating and latching with the component of the bottom hole assembly.

9. The method of claim 8 further comprising establishing a communication connection between the deployable gyro-magnetic survey tool and the component of the bottom hole assembly.

10. The method of claim 5, further comprising transmitting survey data from the deployable gyro-magnetic survey tool to the component of the bottom hole assembly.

11. The method of claim 10, further comprising transmitting the survey data to a surface location.

12. The method of claim 5, further comprising transferring survey data from the component of the bottom hole assembly to the deployable gyro-magnetic survey tool.

13. The method of claim 1, further comprising storing the survey data in a memory of the deployable gyro-magnetic survey tool.

14. The method of claim 1, wherein determining wellbore position information based on the survey data comprises processing the data in the deployable gyro-magnetic survey tool.

15. The method of claim 1, wherein determining wellbore position information based on the survey data comprises processing the data at a surface location.

16. The method of claim 5, wherein determining wellbore position information based on the survey data comprises processing the data in the bottom hole assembly.

17. The method of claim 1, further comprising:

deploying a retrieval device into the wellbore;

connecting the retrieval device to the deployable gyro-magnetic survey tool;

collecting additional survey data during an ascent of the deployable gyro-magnetic survey tool; and determining additional position information based on the additional survey data.

18. The method of claim 1, further comprising:

deploying a second deployable gyro-magnetic survey tool into the wellbore;

collecting additional survey data as the second deployable gyro-magnetic survey tool traverses the wellbore;

determining additional wellbore position information based on the additional survey data.

19. The method of claim 18, further comprising landing the second deployable gyro-magnetic survey tool on the deployable wellbore survey tool.

20. A method of retrieving a gyro-magnetic survey tool, comprising:

deploying a deployable gyro-magnetic survey tool in a drilling assembly while drilling into the wellbore;

collecting survey data as the deployable gyro-magnetic survey tool descends the wellbore;

while drilling, dynamically updating wellbore position information based on the survey data with the survey tool remaining in the wellbore;

deploying a retrieval device into the wellbore;

connecting the retrieval device to the deployable gyro-magnetic survey tool in the drilling assembly while drilling;

collecting survey data as the deployable gyro-magnetic survey tool and drilling assembly ascends the wellbore; and updating wellbore position information based on the survey data collected as the deployable gyro-magnetic survey tool and drilling assembly ascends the wellbore.

21. The method of claim 20, further comprising detaching the deployable gyro-magnetic survey tool from a bottom hole assembly.

22. The method of claim 20, further comprising measuring final position information of the deployable gyro-magnetic survey tool.

23. The method of claim 22, wherein the final position information is based on a known wellhead position and orientation.

24. The method of claim 22, further comprising determining a trajectory of the wellbore based on the final position information and the survey data.

25. The method of claim 22, wherein the final position information is provided by a global positioning service.

26. A deployable gyro-magnetic survey tool, comprising:

a housing;

one or more gyroscopes disposed within the casing; and a lower connector that lands and couples the deployable gyro-magnetic survey tool to a component of a bottom hole assembly thereby configuring the deployable gyro-magnetic survey tool to dynamically transfer survey data to the surface via a telemetry link of the bottom hole assembly with the survey tool remaining in the wellbore, wherein the deployable gyro-magnetic survey tool is configured to be deployed into a wellbore in the bottom hole assembly and collect the survey data during travel between a surface and the bottom hole assembly.

27. The deployable gyro-magnetic survey tool of claim 26, wherein the travel between the surface and the bottom hole assembly is one of a descent or an ascent.

28. The deployable gyro-magnetic survey tool of claim 26, wherein the lower connector is a latch.

29. The deployable gyro-magnetic survey tool of claim 26, further comprising:

one or more accelerometers disposed within the casing; and one or more magnetometers disposed within the casing.

30. The deployable gyro-magnetic survey tool of claim 26, further comprising an upper connector for landing an additional deployable gyro-magnetic survey tool.

31. The deployable gyro-magnetic survey tool of claim 30, further comprising a communications link operably connected to a processor, the lower connector, and the upper connector.

32. The deployable gyro-magnetic survey tool of claim 26, wherein the component of the bottom hole assembly comprises one of a telemetry tool, a downhole survey tool, and a previously deployed deployable wellbore survey tool.

33. The deployable gyro-magnetic survey tool of claim 26, further comprising:

a power source; and a memory; and at least one processor, the processor operably configured to dynamically determine wellbore position information based on the survey data.

* * * * *